US011033157B2

(12) United States Patent
Achton

(10) Patent No.: US 11,033,157 B2
(45) Date of Patent: Jun. 15, 2021

(54) SHEET MATERIAL DISPENSER WITH SPRING LOADED OPERATION TRIGGER

(71) Applicant: Achton A/S, Korsoer (DK)

(72) Inventor: Kim Achton, Korsoer (DK)

(73) Assignee: ACHTON A/S, Korsoer (DK)

( * ) Notice: Subject to any disclaimer, the term of this patent is extended or adjusted under 35 U.S.C. 154(b) by 0 days.

(21) Appl. No.: 16/326,295

(22) PCT Filed: Aug. 16, 2017

(86) PCT No.: PCT/EP2017/070766

§ 371 (c)(1),
(2) Date: Feb. 18, 2019

(87) PCT Pub. No.: WO2018/033572

PCT Pub. Date: Feb. 22, 2018

(65) Prior Publication Data

US 2019/0183298 A1 Jun. 20, 2019

(30) Foreign Application Priority Data

Aug. 19, 2016 (GB) ..... 1614177

(51) Int. Cl.
*A47K 10/36* (2006.01)

(52) U.S. Cl.
CPC ..... *A47K 10/3637* (2013.01); *A47K 10/36* (2013.01); *A47K 2010/3675* (2013.01)

(58) Field of Classification Search
CPC ..... A47K 10/3637; A47K 10/36; A47K 2010/3675
See application file for complete search history.

(56) References Cited

U.S. PATENT DOCUMENTS

1 A * 7/1836 Ruggels ..... B61C 11/04 295/4
3 A * 8/1836 Blanchand ..... G01B 7/107 142/42
2,135,767 A * 11/1938 Price ..... A47K 10/36 242/564.1
2,973,958 A * 3/1961 Casey ..... A47K 10/38 226/130

(Continued)

FOREIGN PATENT DOCUMENTS

EP 2567646 A1 3/2013
FR 2533124 3/1984

OTHER PUBLICATIONS

International Search Report for Application No. GB1614177.2 dated Jan. 12, 2017, three pages.

*Primary Examiner* — Michael E Gallion
(74) *Attorney, Agent, or Firm* — MacCord Mason PLLC

(57) ABSTRACT

A sheet material dispenser comprising an operation trigger and a rotatable drum for frictionally engaging sheet material to be dispensed, in which said operation trigger is manually movable in a first direction from a stand-by position to a depressed position, in which said dispenser comprises a return spring which drives said operation trigger in a second direction from said depressed position to said stand-by position, and in which said operation trigger comprises a releasable engagement mechanism which engages said drum and rotates it only when said operation trigger is moved in said second direction.

10 Claims, 7 Drawing Sheets

(56) References Cited

U.S. PATENT DOCUMENTS

| | | | | |
|---|---|---|---|---|
| 3,606,125 | A * | 9/1971 | Tucker | A47K 10/36 226/130 |
| 3,672,552 | A * | 6/1972 | Krueger | A47K 10/36 226/129 |
| 4,192,442 | A | 3/1980 | Bastian et al. | 226/127 |
| 6,206,322 | B1 * | 3/2001 | Elliott | A47K 10/36 192/17 R |
| 6,684,751 | B2 * | 2/2004 | Kapiloff | A47K 10/3643 225/16 |
| 7,896,285 | B2 * | 3/2011 | Wruck, Jr. | A47K 10/36 242/564.2 |
| 9,878,869 | B2 * | 1/2018 | Morand | A47K 10/36 |
| 10,470,622 | B2 * | 11/2019 | Goeking | A47K 10/38 |
| 2006/0138274 | A1 * | 6/2006 | Goeking | A47K 10/36 242/564.4 |
| 2009/0212150 | A1 * | 8/2009 | Wruck, Jr. | A47K 10/36 242/564.2 |
| 2011/0132955 | A1 * | 6/2011 | Achton | A47K 10/36 225/10 |

* cited by examiner

SHEET MATERIAL DISPENSER WITH SPRING LOADED OPERATION TRIGGER

The present invention relates to a sheet material dispenser with a spring loaded operation trigger, for use particularly, but not exclusively, as a paper towel dispenser.

Paper towel dispensers come in various forms, including simple housings from which pre-cut paper towels can be drawn, to more complex mechanisms which cut the towels from a roll of paper towel material. One issue with the former type is the energy and resources required to manufacture the towels to be dispensed. The paper towels are cut and folded during manufacture, and then stacked and packaged for placement in a dispenser. With the latter dispenser type the manufacturing costs are lower because a roll of paper towel material is easier to produce.

There are a number of known dispenser types which comprise an integrated cutting mechanism. One in particular uses a rotating drum to cut the paper towels and to eject them from the dispenser in a single movement. The roll of sheet material is arranged in a bay above the drum, and the drum is arranged in a path of the sheet material extending from the bay to an outlet of the dispenser. The drum has a surface which frictionally engages the paper, so rotation of the drum draws paper from the roll and ejects it from the outlet. The drum comprises a knife of some kind which enters the path of the sheet material at a cutting angle of the drum, thereby to cut one paper towel from the roll. In one version of this kind of product the drum comprises a spring loaded drive mechanism which rotates it through part of its 360 degrees of rotation from a launch angle to a start position. In use a user pulls on a section of paper towel material protruding from the outlet, and this rotates the drum from the start position to the launch angle, due to the frictional engagement of the paper on the surface of the drum. Once the launch angle is reached the drum is then driven around the rest of its rotation, during which it cuts the paper in order to deliver to the user one paper towel. The drive mechanism continues to rotate the drum after this so a section of the paper towel material is left protruding from the outlet.

Paper towel dispensers of this kind can fail, for example if the control spring which drives the drum fails, or if there is a paper jam somewhere in the mechanism. Therefore, it is known to provide a manual override in the form of an operation trigger, the depression of which rotates the drum directly. Such a feature only works to dispense paper towels if the drum can still be rotated, and/or if the paper jam, or other fault, can be cleared. If not, then the operation trigger will resist depression, and another solution will have to be found.

However, in practice the user is a member of the public, or is someone who is not familiar with the workings of the dispenser, and if the operation trigger resists depression they may continue to attempt to depress it with greater and greater force. Usually this is done until further damage is caused to the mechanism.

The present invention is intended to overcome some of the above problems. Therefore, according to the present invention, a sheet material dispenser comprises an operation trigger and a rotatable drum for frictionally engaging sheet material to be dispensed, in which said operation trigger is manually movable in a first direction from a stand-by position to a depressed position, in which said dispenser comprises a return spring which drives said operation trigger in a second direction from said depressed position to said stand-by position, and in which said operation trigger comprises a releasable engagement mechanism which engages said drum and rotates it only when said operation trigger is moved in said second direction.

Thus, the present invention provides a manual override feature which only drives the dispensing mechanism on the return movement of the operation trigger. This means that the strength of the manual override can be controlled by the choice of return spring strength, and in particular to a level below that which could cause greater damage to the dispenser. It also means that users will not be able to apply greater and greater force to a resistive operation trigger as they can with known examples in the manner described above.

The releasable engagement mechanism can be any know mechanical mechanism for driving a drum in one direction only, including any known type of rack and pinion, ratchet or frictional engagement. However, in a preferred embodiment the drum can comprise a ratchet cogwheel at a first end thereof, and the operation trigger can comprise a rack of angled teeth which can engage the ratchet cogwheel and rotate it when the operation trigger is moved in the second direction. The angled teeth can be resilient and can deflect under the ratchet cogwheel when the operation trigger is manually moved in the first direction.

The return spring can be any known spring device which can act on an operation trigger to drive it in one direction. This could be a spring which is placed under extension when the operation trigger is moved in the first direction, and it can be any kind of spring, such as a leaf spring, a resilient cord or coil spring. However, in a preferred embodiment the operation trigger can be mounted on a track and the return spring can comprise a coil spring mounted between the operation trigger and a rear wall of the dispenser. As such the coil spring is placed under compression when the operation trigger is moved in the first direction, and extends to drive the operation trigger in the second direction.

The operation trigger can be located anywhere on the dispenser where it can be readily accessed by a user and can act on the drum, for example above it or alongside it. However, preferably the dispenser can comprise a bottom wall; the track can comprise a slot in the bottom wall, and the operation trigger can comprise a manual engagement surface which protrudes from the slot. Therefore, the user can manually activate the operation trigger by pushing against the manual engagement surface which protrudes from the underside of the bottom wall of the dispenser.

Preferably, the manual engagement surface can be a stand-alone feature. However in an alternative construction a front cover of the dispenser can be hinged to a top of the dispenser so a bottom of the front cover can rotate back and forth, the operation trigger can be integral with the front cover, and the manual engagement surface can be the front cover itself. Therefore, the user can manually activate the operation trigger by depressing the front cover of the dispenser.

Preferably the operation trigger can comprise a spring support rod; the rear wall of the dispenser can comprise an aperture through which the support rod can pass, and the coil spring can be mounted on the rod. This is an expedient mechanical way to retain the return spring in the correct position to act on the operation trigger.

The rotatable drum can be any of the known kinds which are used in sheet material dispensers, including those which simply rotate in a uniform motion when acted upon. However, in one embodiment of the invention the rotatable drum can be rotatable through 360 degrees, and can comprise a spring loaded drive mechanism which rotates it through part of the 360 degrees from a launch angle to a start position.

The drum can be manually rotatable from the start position to the launch angle in normal use. This can be done by turning a knob, or by the user pulling sheet material protruding from the dispenser which acts on the drum. However, in addition to this, movement of the operation trigger in the second direction from the depressed position to the stand-by position can rotate the drum from the start position to the launch angle.

With this configuration the operation trigger need only act on the drum to turn it through a portion of 360 degrees, from the start position to the launch angle, in order for the drum to then perform a full 360 degree rotation. This means the linear movement of the operation trigger from the depressed position to the stand-by position can be short.

Following on from the above, the dispenser can comprise support means for rotationally supporting a roll of sheet material to be dispensed, and a sheet material path from the support means to an outlet. The drum can then be arranged in the path such that it frictionally engages sheet material with which the dispenser is used, and such that the drum is manually rotatable from the start position to the launch angle by manual manipulation of sheet material protruding from the outlet, as explained above. Further, the drum can comprise a radially extending cutting knife which can enter the path at a cutting angle of the drum. This feature allows for the dispenser to dispense cut measured sheets of material from a roll of sheet material. As explained above, such rolls of material are cheap and easy to manufacture compared to cut and folded sheets of material. The cutting angle of the drum can be set by the skilled person, but it is usual to have it after the launch angle, but some distance before the start position. Therefore, a user can pull on a section of sheet material protruding from the outlet in order to rotate the drum from the start position to the launch angle, due to the frictional engagement of the sheet material on the surface of the drum. Once the launch angle is reached the drum is then driven around the rest of its rotation, during which the knife cuts the sheet material, thereby delivering to the user one piece of sheet material. The drum then drives the sheet material further through the rest of its rotational motion until another section thereof is left protruding from the outlet for the same action to be performed once again.

The present invention can be performed in various ways, but one embodiment will now be described by way of example and with reference to the accompanying drawings, in which.

Figure 1:
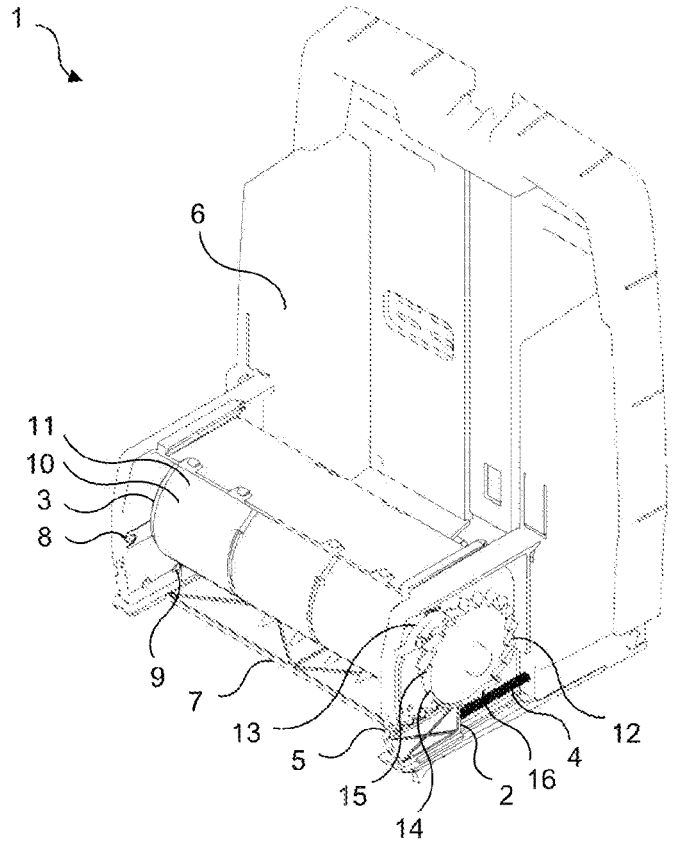
FIG. 1 is a perspective view of the relevant components of a dispenser according to the present invention.
Figure 3:
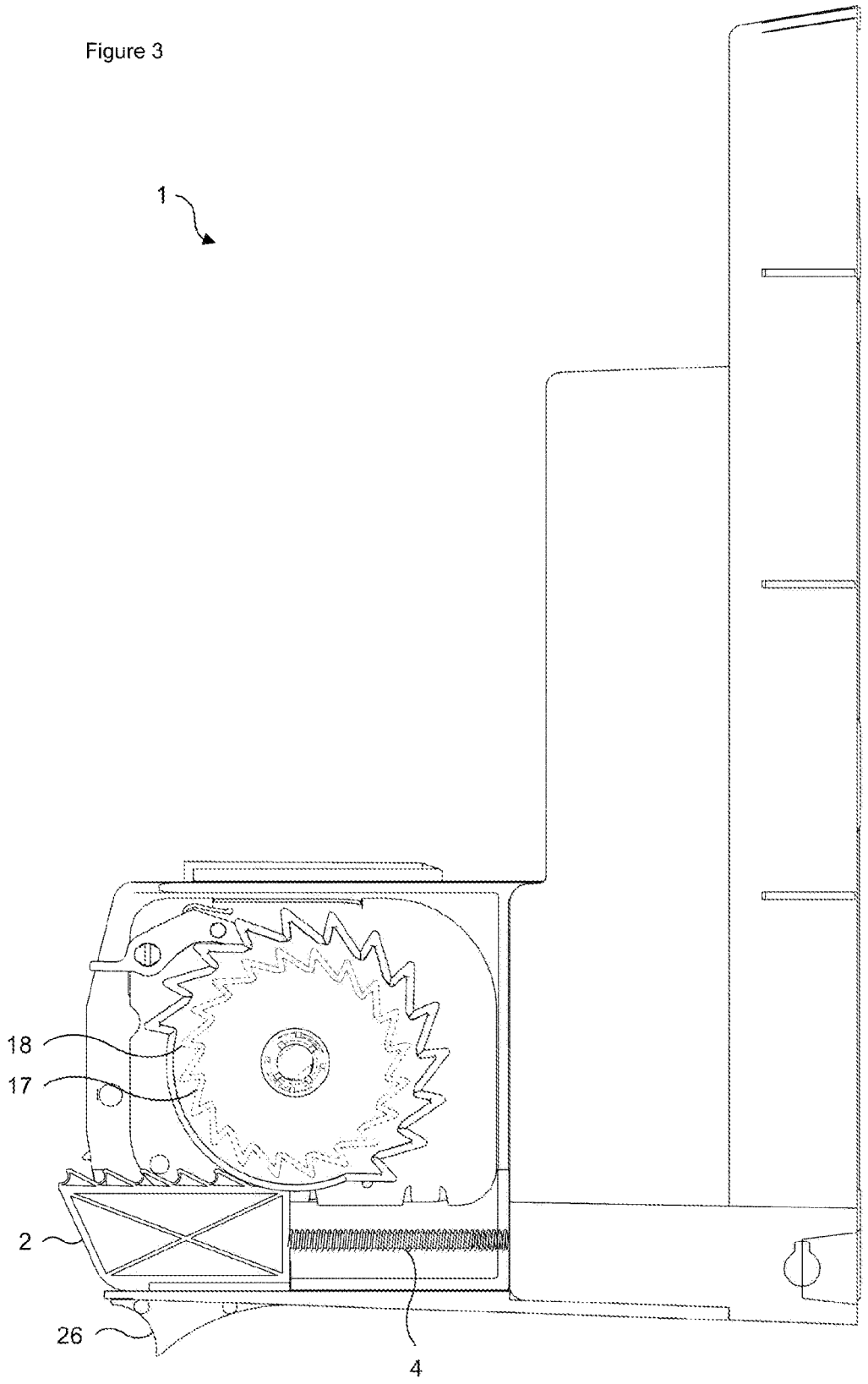
FIG. 3 is a side view of the dispenser shown in FIG. 1 with an operation trigger part thereof in a stand-by position.
Figure 5:
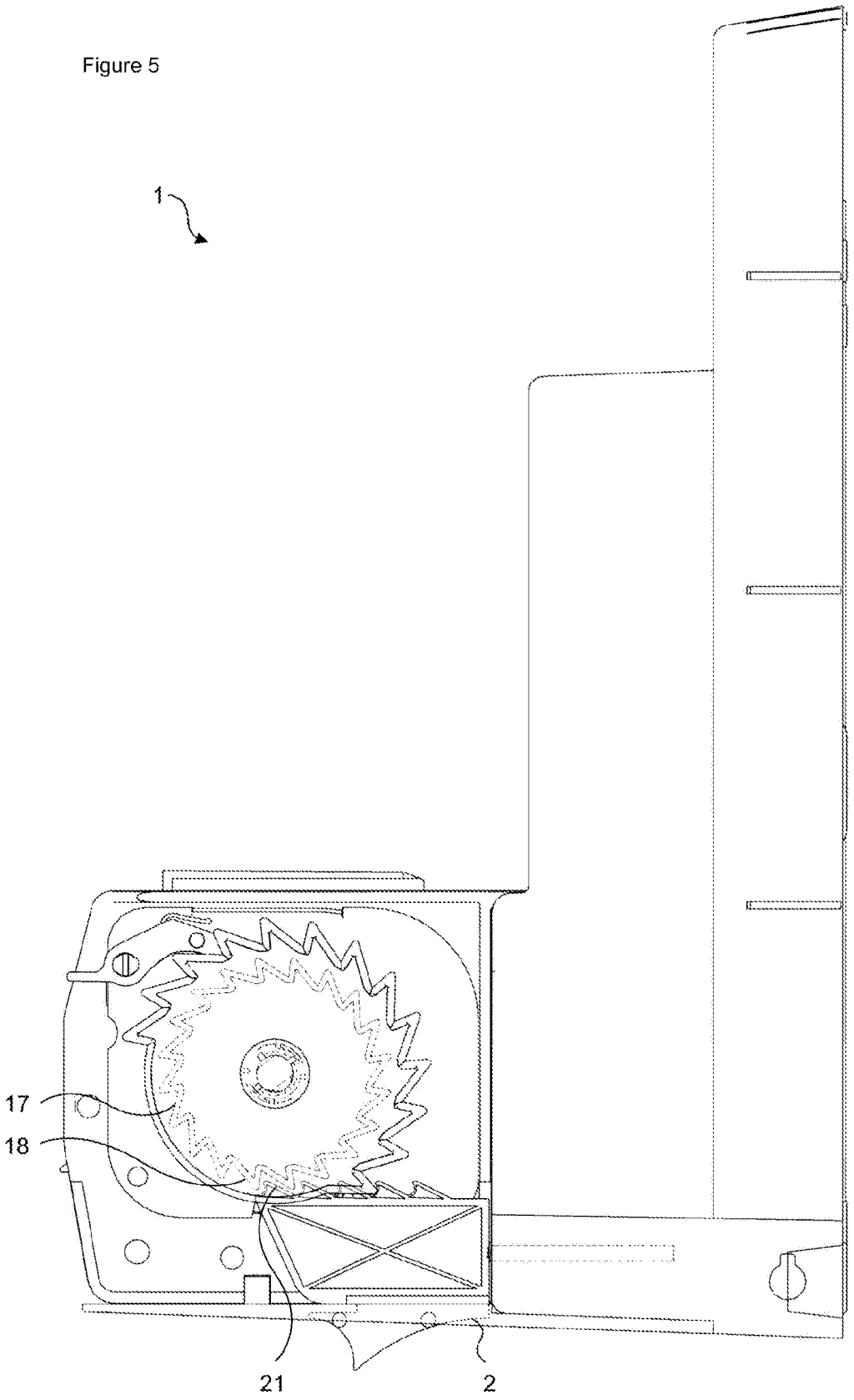
FIG. 5 is a side view of the dispenser shown in FIG. 1 with the operation trigger part thereof in the depressed position.

As shown in FIG. 1, a sheet material dispenser 1 comprises an operation trigger 2 and a rotatable drum 3 for frictionally engaging sheet material to be dispensed (not shown). As explained further below, the operation trigger 2 is manually movable in a first direction from a stand-by position, as shown in FIG. 3, to a depressed position, as shown in FIG. 5. The dispenser 1 comprises a return spring 4 which drives the operation trigger 2 in a second direction from the depressed position to the stand-by position. The operation trigger 2 comprises a releasable engagement mechanism 5 which engages the drum 3 and rotates it only when the operation trigger 2 is moved in the second direction.

The dispenser 1 is a paper towel dispenser which is generally of a known kind. In particular, it comprises a bay area 6 in which a roll of paper (not shown) is rotationally supported between a pair of arms (not shown). A path for the paper extends downwards from the bay area 6 to an outlet 7. The drum 3 is arranged in the path and the paper, such that the paper passes onto the drum 3, is directed rearwardly around the drum 3, and then forward out of the outlet 7. A feeding roller (not shown) is arranged in front of the drum 3 to direct the paper onto the drum 3. An outlet roller (not shown) is arranged under the drum 3 to direct the paper towards the outlet 7. The paper is held in contact with the drum 3 between the feeding roller and the outlet roller. The locations of the feeding roller and the outlet roller can be ascertained from the respective mounting points 8 and 9. The outer surface 10 of the drum 3 comprises a frictional engagement material 11, which facilitates frictional engagement between the drum 3 and the paper.

Figure 7:
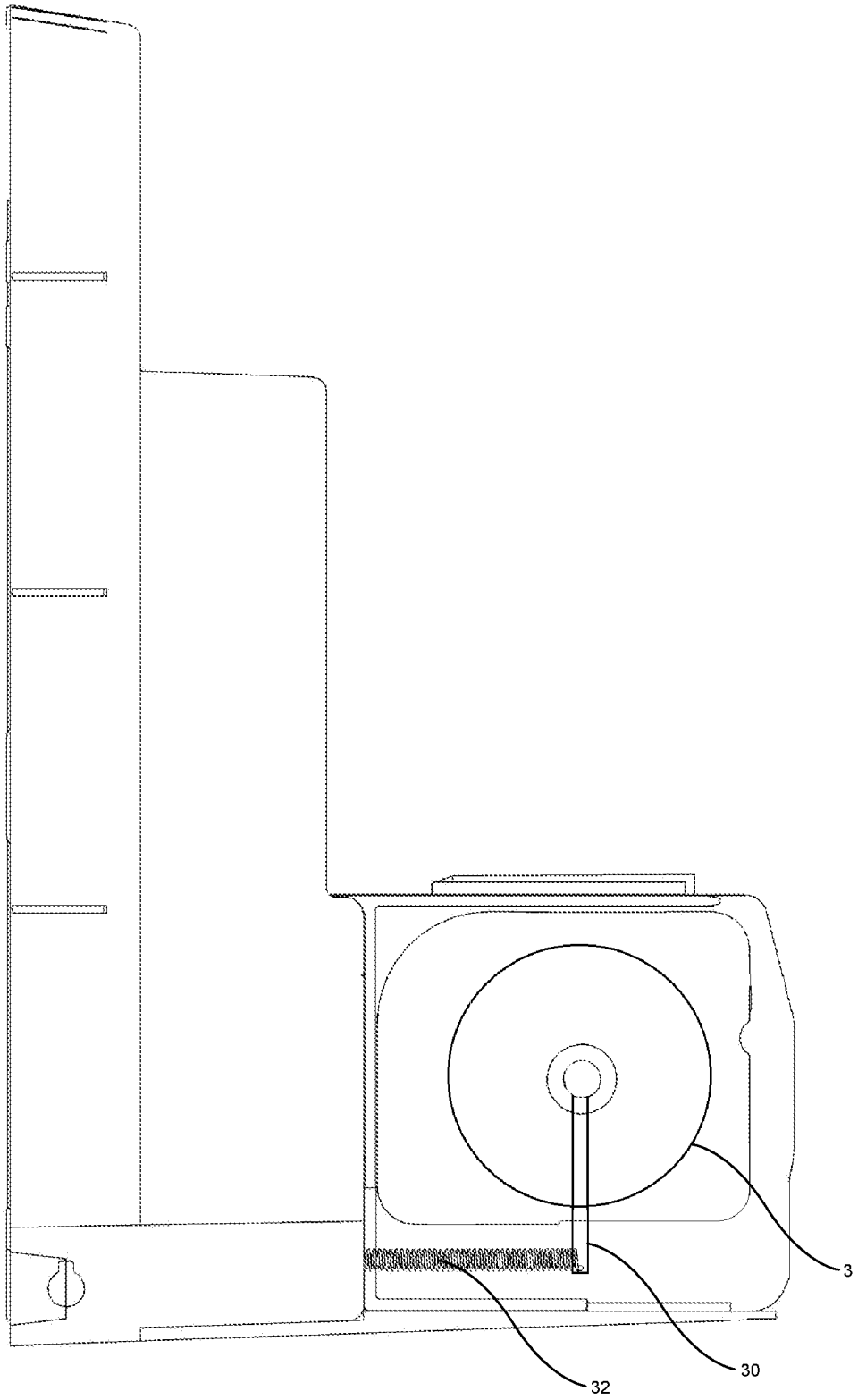
FIG. 7 is a side view of the dispenser shown in FIG. 1 in which a spring loaded drive mechanism is visible.

The drum 3 is rotatable through 360 degrees, and comprises a known type of spring loaded drive mechanism shown in FIG. 7 which rotates it through part of the 360 degrees from a launch angle to a start position. The spring loaded drive mechanism is provided at the opposite end of the drum 3 to that which is visible in the Figures, and comprises a radial arm 30 extending from the drum 3 and a control coil spring 32. An outer end of the radial arm is mounted to a first end of the control coil spring, and a second end of the control coil spring is statically mounted to the dispenser 1. In the start position of the drum 3 shown in FIGS. 1 to 3 and 7 the radial arm extends downwards, and the control coil spring is arranged substantially horizontally, under a small amount of extension. As the drum 3 rotates in use, as described further below, the outer end of the radial arm follows a planetary path about an axis of the drum 3, thereby rotating the control coil spring about its second end and placing it under increasing extension. This continues through about 120 degrees of rotation until the angles of the radial arm 30 and the control coil spring 32 align, and the outer end of the radial arm goes over centre. This is the launch angle of the drum 3. Past this angular point the control coil spring 32 contracts and pulls the outer end of the radial arm 30 further around its planetary path. This continues through 180 degrees until the angles of the radial arm and the control coil spring align once again in the other direction. At this point the momentum of the drum 3 means it continues to rotate through the final 60 degrees or so back to the start position. Therefore, to make the drum 3 perform a full 360 degrees of rotation it is only necessary to manually rotate it through 120 degrees from the start position to the launch angle. The spring loaded drive mechanism does the rest.

The drum 3 is connected to a first ratchet cogwheel 12 at the opposite end to the spring loaded drive mechanism. This first cogwheel 12 is controlled by a pawl 13, so it can only rotate in a clockwise direction. This means that through the initial 120 degrees of rotation of the drum 3 from the start position to the launch angle the ratchet mechanism provided by the first cogwheel 12 and the pawl 13 prevents the drum 3 from being rotated in an anti-clockwise direction by the force of the control coil spring as it is placed under increasing extension. The first cogwheel 12 comprises a blank section 14, a beginning 15 of which approximately angularly coincides with the launch angle. An end 16 of the blank section 14 approximately angularly coincides with the angular point at which the angles of the radial arm and the control coil spring align for the second time. The blank section 14 prevents the pawl 13 from generating a resistance to the contraction force of the control coil spring as it rotates the drum 3 from the launch angle. As the momentum of the drum 3 carries it through the final 60 degrees or so of its 360 degrees of motion the ratchet mechanism provided by the first cogwheel 12 and the pawl 13 is active once again, to prevent the drum 3 from rotating in an anti-clockwise direction. Once the drum 3 reaches the start position once again the pawl 3 engages the first cogwheel 12 and prevents the drum 3 from rotating in an anti-clockwise direction under the force of the control coil spring.

The drum 3 comprises a radially extending cutting knife (not visible) which enters the path of the paper at a cutting angle of the drum 3. This occurs in the angular vicinity of the launch angle, but the cutting action only occurs after that point. This is necessary to ensure that a user pulling on paper protruding from the outlet 7 and thereby rotating the drum 3, can continue to do so until at least the launch angle is achieved. If not, a piece of paper would be cut and dispensed from the dispenser 1 before the launch angle were achieved, and the spring loaded drive mechanism would not operate to feed another section of paper out of the outlet 7 for the next dispensing action.

As explained above, the drum 3 can be manually rotatable from the start position to the launch angle by the user pulling on a section of paper which protrudes from the outlet 7. This turns the drum 3 because of the frictional engagement between the paper and the frictional material 11 on the outer surface 10 of the drum 3. However, the dispenser 1 is also provided with a knob (not visible) by which the drum 3 can be manually rotated through about 120 degrees from the start position to the launch angle. This can be used instead of pulling on paper protruding from the outlet 7, or if no paper protrudes from the outlet 7, either because it has been torn off, or during loading of the dispenser 1 when the paper has not yet been fed to the outlet 7.

Figure 2:
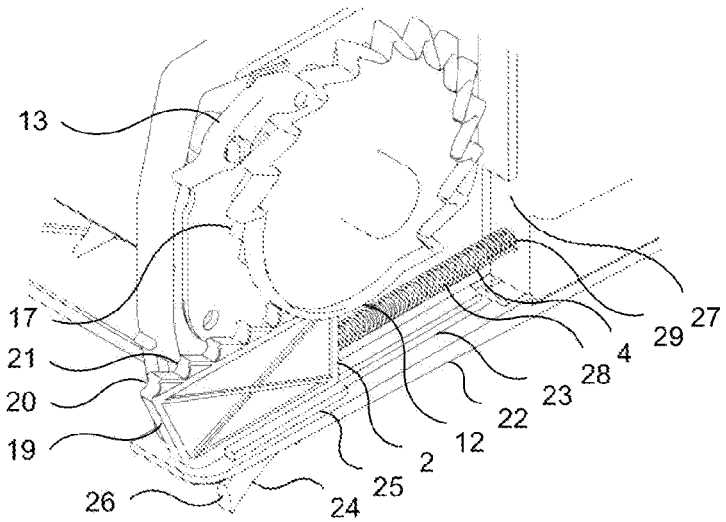
FIG. 2 is a partial perspective view of the dispenser shown in FIG. 1.

Referring now to FIG. 2, the drum comprises a second ratchet cogwheel 17 which is mounted to the drum 3 inside the first ratchet cogwheel 12. The first and second ratchet cogwheels 12 and 17 are co-axial, and are rotationally fixed in relation to one another. The full shape of the second ratchet cogwheel 17 is shown in hashed lines in FIGS. 3 to 6, and it can be seen from these figures that it comprises teeth 18. The operation trigger 2 is arranged underneath the second cogwheel 17, and comprises a body 19 with a rack 20 of angled teeth 21, which are for co-operation with the teeth 18 of the second cogwheel 17, as explained in more detail below. The angled teeth 21 are made from a resilient plastics material, so they can be deflected downwards. This allows the operation trigger 2 to be moved in the first direction under the second cogwheel 17. It is these features which provide for the releasable engagement mechanism 5 of the invention.

The dispenser 1 comprises a bottom wall 22, in which is formed a slot 23. The operation trigger 2 is mounted for linear reciprocal movement in the slot 23. It comprise a lower section 24 which extends through the slot 23, and flange members (only one of which 25 is visible) which abut against the bottom wall 22 to maintain the operation trigger 2 in the position shown. The lower section 24 comprises a manual engagement surface 26, which can be accessed by a user to push the operation trigger 2 in the first direction, as explained below.

The return spring 4 comprises a coil spring mounted between the operation trigger 2 and a rear wall 27 of the dispenser 1. As such, the return spring 4 is placed under compression when the operation trigger 2 is moved in the first direction, and extends to drive the operation trigger 2 in the second direction. To hold the return spring 4 in this position the operation trigger 2 comprises a spring support rod 28 on which the return spring 4 is mounted. The rear wall 27 of the dispenser 1 comprises an aperture 29 through which the support rod 28 can pass when the operation trigger 2 is moved in the first direction, as explained further below.

The length of the slot 23 is such that the linear movement of the operation trigger 2 in the second direction under the force of the return spring 4 is sufficient in length for the second cogwheel 17 to be rotated through 120 degrees, so the drum 3 moves from the start position to the launch angle. It will be appreciated that this is a relatively short distance.

In use the dispenser 1 operates as follows. The dispenser 1 is loaded with a roll of paper to be dispensed, and the paper is fed over the drum 3 and out of the outlet 7 in the known way. To obtain a paper towel a user pulls on paper protruding from the outlet 7, which rotates the drum 3 from the start position to the launch angle. Once the launch angle is reached the spring loaded drive mechanism rotates the drum 3 automatically through the rest of its rotational movement. The paper is cut by the cutting knife after the launch angle is reached, thereby forming a piece of paper which is dispensed to the user. As the drum 3 continues to rotate it feeds more paper towards and then through the outlet 7, leaving another piece for another user to pull on. Alternatively, the operation knob can be rotated to dispense a piece of paper in the same way.

In the event of a failure or paper jam the dispenser 1 may cease to work correctly. No paper may protrude from the outlet 7, or if it does it may by jammed. The operation knob may fail so it cannot be used to rotate the drum 3. If so, the operation trigger 2 can be used to try to force the dispenser to operate once again.

Figure 4:
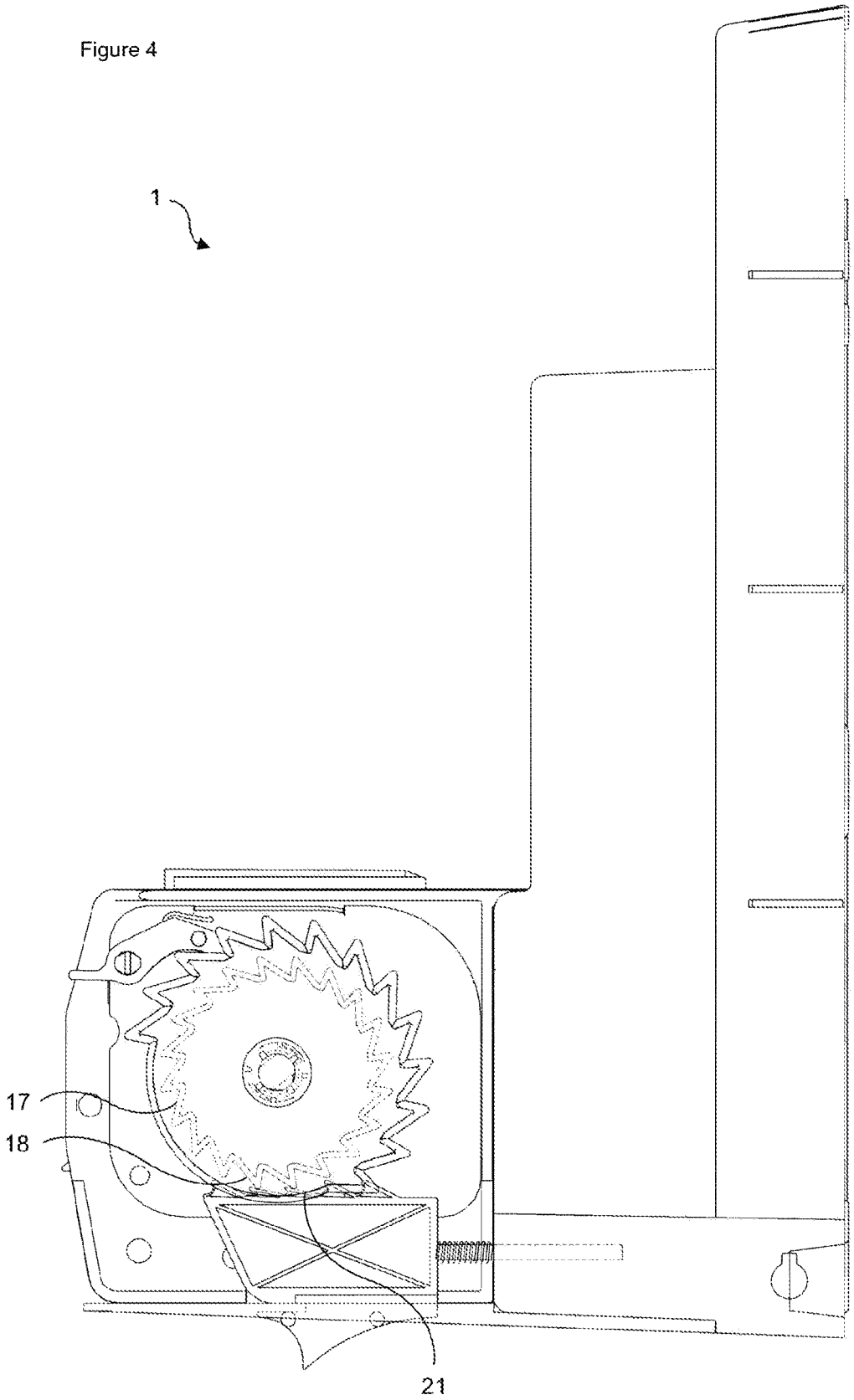
FIG. 4 is a side view of the dispenser shown in FIG. 1 with the operation trigger part thereof between the stand-by position and a depressed position.

The user pushes the manual engagement surface 26 to move the operation trigger 2 in the first direction from the stand-by position as shown in FIG. 3, to the depressed position shown in FIG. 5. The first direction being to the right in the Figures. During this movement the operation trigger 2 moves up the slot 23, the support rod 28 passes through the aperture 29, and the return spring 4 is compressed. In addition, as shown in FIG. 4, the angled teeth 21 are deflected downwards by the teeth 18 of the second cogwheel 17. This occurs because the teeth 21 and 18 face in opposite directions, and the longer angled sides of the teeth 18 force the longer angled sides of the teeth 21 down. As such, the teeth 21 and 18 do not engage one another and no rotational movement is transmitted to the second cogwheel 17.

Figure 6:
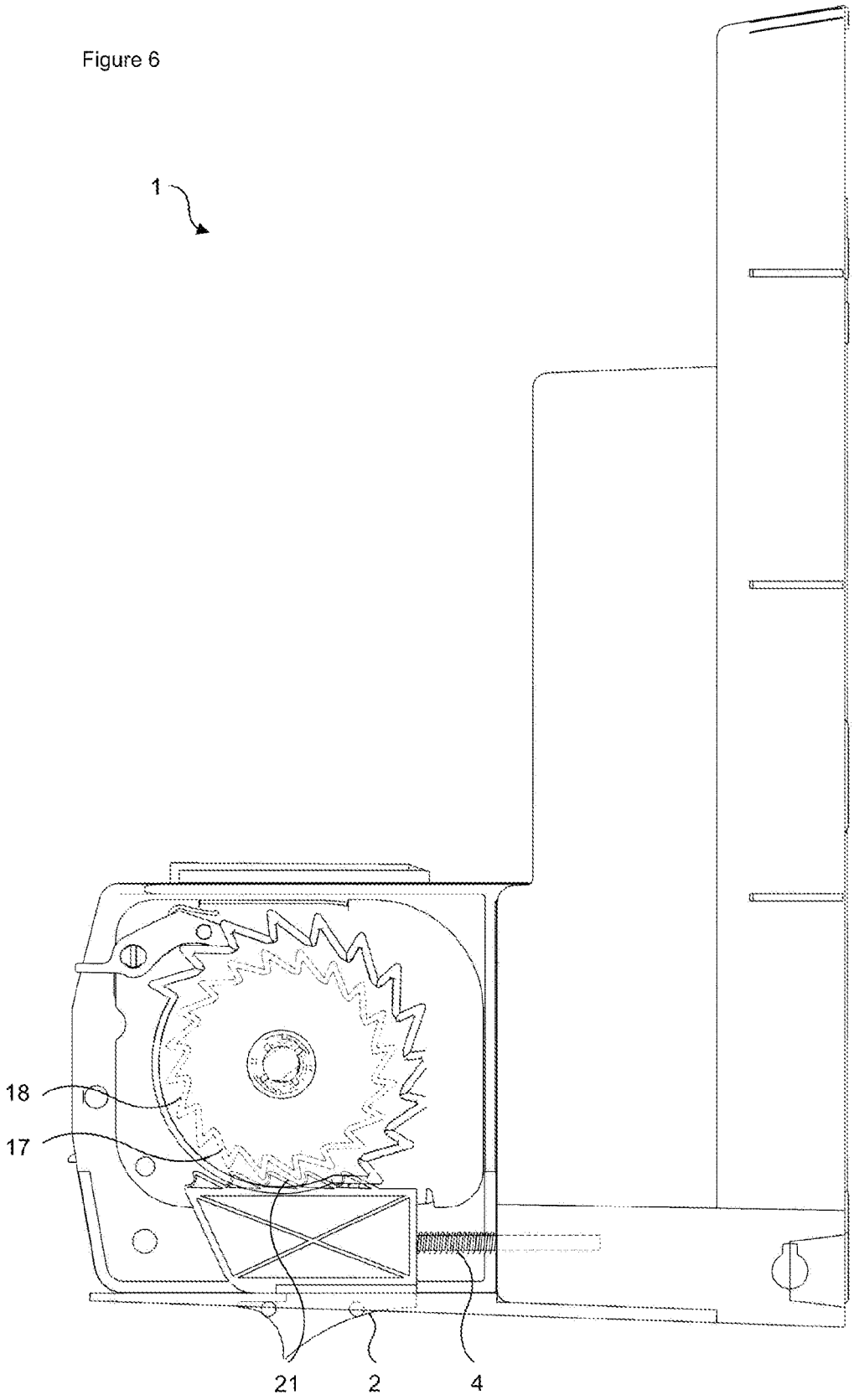
FIG. 6 is a side view of the dispenser shown in FIG. 1 with the operation trigger part between the depressed position and the stand-by position.

Once the operation trigger 2 has reached the depressed position shown in FIG. 5, the user releases the operation trigger 2, and it is then moved in the second direction from the depressed position back to the stand-by position by the return spring 4. The second direction being to the left in the Figures. During this movement the operation trigger 2 moves back down the slot 23, the support rod passes back out of the aperture 29, and the return spring 4 extends. As shown in FIG. 6, when the operation trigger 2 moves in the section direction the short upright sides of the teeth 21 engage the short upright sides of the teeth 18, and the second cogwheel 17 is rotated in a clockwise direction.

The movement of the operation trigger 2 in the second direction rotates the second cogwheel 17 through 120 degrees, so the drum 3 moves from the start position to the launch angle. In FIG. 6 the second cogwheel 21 has only been moved through an initial part of this 120 degrees of rotation. Once the drum 3 reaches the launch angle the spring loaded drive mechanism takes over and rotates the drum 3 through the rest of its 360 degrees of rotational movement.

In the event that a fault can be cleared by the force of the return spring 4 acting on the drum 3, then the above described operation will result in the dispenser 1 returning to correct functionality.

However, in the event that the fault is more serious, and the force of the return spring 4 is not sufficient to clear it, the operation trigger 2 will remain in the depressed position shown in FIG. 5. Any further attempt by the user to apply greater force to the operation trigger 2 will not result in any such force being transmitted to the drum 3. This is the advantage the present invention provides over known arrangements in which movement of an operation trigger in the first direction rotates the drum. The extension force of the return spring 4 is such that it is sufficient to clear the majority of paper jams, but insufficient to damage other parts of the dispenser 1, for example to snap the radial arm of the spring loaded drive mechanism.

The present invention can be performed in various other ways which fall within the scope of claim 1. For example in one alternative embodiment (not shown) the return spring is arranged on the other side of the operation trigger, and is placed under extension when the operation trigger is moved in the first direction.

In another alternative embodiment (not shown) the operation trigger extends laterally out of the dispenser as opposed to downwardly.

Figure 8:
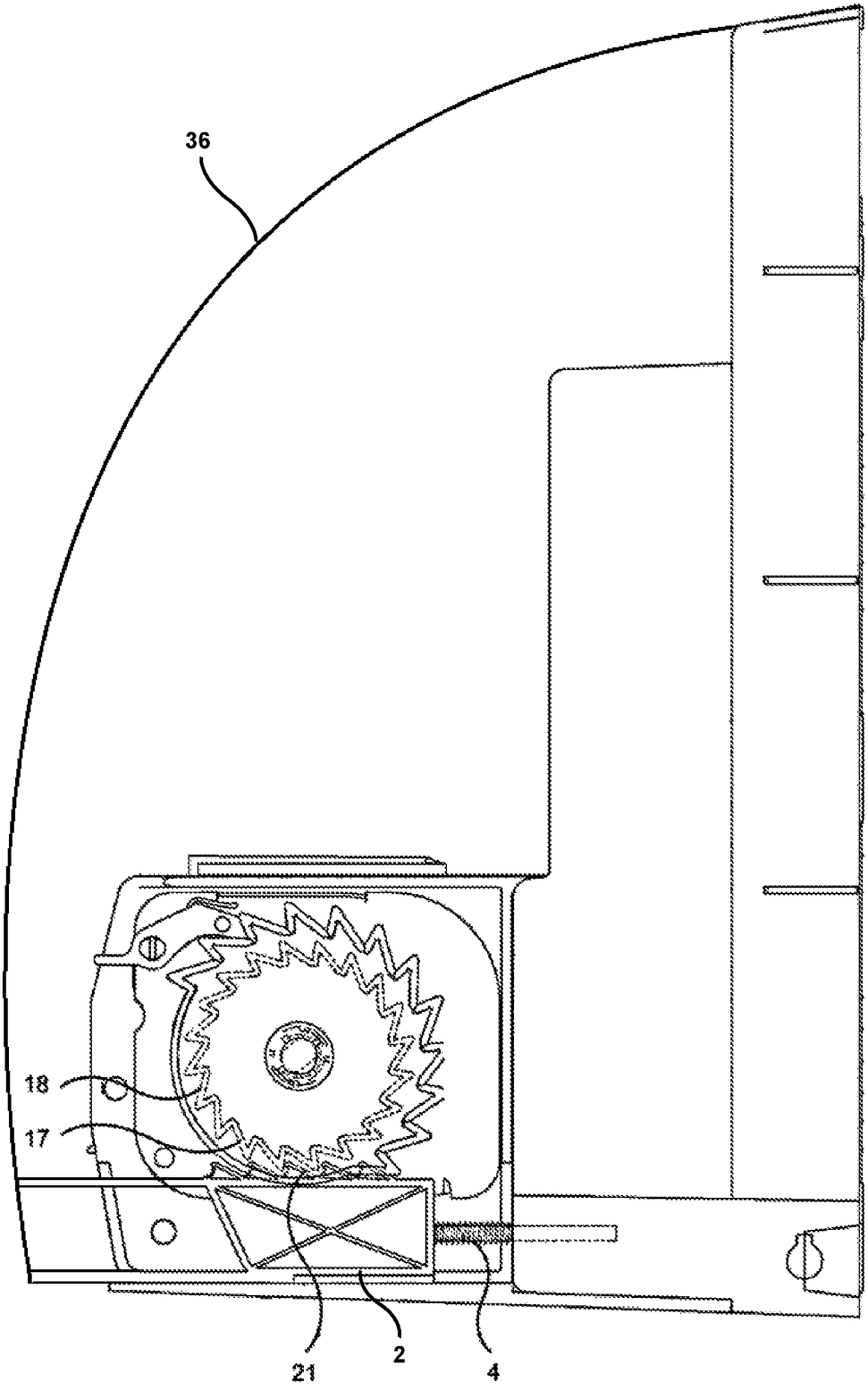
FIG. 8 is a side view of an alternative dispenser.

In another alternative embodiment (shown in FIG. 8) a front cover 36 of the dispenser is hinged to a top of the dispenser so a bottom of the front cover rotates back and forth, and the operation trigger 2 is integral with the front cover. As such the manual engagement surface is the front cover 36 itself, and the user can manually activate the operation trigger by depressing the front cover 36 of the dispenser.

Therefore, the present invention provides a manual override feature for a paper towel dispenser which only drives the dispensing mechanism on the return movement of the operation trigger. This prevents users from applying greater and greater force to a resistive operation trigger as they can with known examples, which can lead to greater damage being caused. It also allows the strength of the manual override to be controlled by the choice of return spring strength, and in particular to a level below that which could cause greater damage to the dispenser.

The invention claimed is:

1. A sheet material dispenser comprising an operation trigger and a rotatable drum for frictionally engaging sheet material to be dispensed, in which said rotatable drum is rotatable through 360 degrees, in which said operation trigger is manually movable in a first direction from a stand-by position to a depressed position, in which said dispenser comprises a return spring which drives said operation trigger in a second direction from said depressed position to said stand-by position, and in which said operation trigger comprises a releasable engagement mechanism which engages said drum and rotates said drum only when said operation trigger is moved in said second direction, in which said drum comprises a spring loaded drive mechanism which rotates the drum through part of said 360 degrees from a launch angle to a start position, in which said drum is manually rotatable from said start position to said launch angle, and in which movement of said operation trigger from said depressed position to said stand-by position rotates said drum from said start position to said launch angle, to allow further rotation of said drum by said spring loaded drive mechanism from said launch angle back to said start position.

2. A sheet material dispenser as claimed in claim 1 in which said drum comprises a ratchet cogwheel at a first end thereof, in which said operation trigger comprises said releasable engagement mechanism as a rack of angled teeth which engage said ratchet cogwheel and rotate said ratchet cogwheel when said operation trigger is moved in said second direction.

3. A sheet material dispenser as claimed in claim 2 in which said angle teeth are resilient and deflect under said ratchet cogwheel when said operation trigger is manually moved in said first direction.

4. A sheet material dispenser as claimed in claim 3 in which said operation trigger is mounted on a track and said return spring comprises a coil spring mounted between said operation trigger and a rear wall of said dispenser.

5. A sheet material dispenser as claimed in claim 4 in which said dispenser comprises a bottom wall, in which said track comprises a slot in said bottom wall, and in which said operation trigger comprises a manual engagement surface which protrudes from said slot.

6. A sheet material dispenser as claimed in claim 5 in which said dispenser comprises a front cover which is hinged to a top of said dispenser so a bottom of said front cover is rotatable back and forth, in which said operation trigger is integral with said front cover, and in which said manual engagement surface is said front cover.

7. A sheet material dispenser as claimed in claim 5 in which said operation trigger comprises a spring support rod, in which said rear wall of said dispenser comprises an aperture through which said support rod passes, and in which said coil spring is mounted on said rod.

8. A sheet material dispenser as claimed in claim 1 in which said drum is arranged such that said drum frictionally engages sheet material with which said dispenser is used, and such that said drum is manually rotatable from said start position to said launch angle by manual manipulation of sheet material protruding from an outlet of said sheet material dispenser.

9. A sheet material dispenser as claimed in claim 6 in which said operation trigger comprises a spring support rod, in which said rear wall of said dispenser comprises an aperture through which said support rod passes, and in which said coil spring is mounted on said rod.

10. A sheet material for dispensing sheet material, the dispenser comprising a rotatable drum for frictionally engaging sheet material to be dispensed, in which the rotatable drum is rotatable through 360 degrees, a spring loaded drive mechanism which rotates the drum through part of the 360 degrees from a launch angle to a start position, and in which manual rotation of the drum from the start position to the launch angle allows further rotation of the drum by the spring loaded drive mechanism from the launch angle back to the start position, a manual override including an operation trigger that is manually movable in a first direction from a stand-by position to a depressed position and in a second direction from the depressed position to the stand-by position, a return spring which drives the operation trigger in the second direction, and in which the operation trigger has a releasable engagement mechanism which engages and rotates the drum only when the operation trigger moves in the second direction, and in which movement of the operation trigger in the second direction rotates the drum from the start position to the launch angle, thereby allowing further rotation of the drum by the spring loaded drive mechanism from the launch angle back to the start position.

* * * * *